United States Patent [19]

Masuda et al.

[11] Patent Number: 4,873,946

[45] Date of Patent: Oct. 17, 1989

[54] TWO-CYCLE INTERNAL COMBUSTION ENGINE

[75] Inventors: Isao Masuda, Tachikawa; Takashi Fukuoka, Fuchu; Fujio Kobayashi, Hachioji, all of Japan

[73] Assignee: Kioritz Corporation, Tokyo, Japan

[21] Appl. No.: 230,141

[22] Filed: Aug. 9, 1988

[30] Foreign Application Priority Data

Aug. 25, 1987 [JP] Japan ..... 62-128863[U]

[51] Int. Cl.[4] ..... F02B 33/04

[52] U.S. Cl. ..... 123/65 PD; 123/73 PP

[58] Field of Search ..... 123/65 P, 65 PD, 65 W, 123/41.35, 73 PP

[56] References Cited

U.S. PATENT DOCUMENTS 4,651,686 3/1987 Kania ..... 123/65 P

FOREIGN PATENT DOCUMENTS 55415422 12/1978 Japan .

59338 4/1983 Japan ..... 123/65 PD

*Primary Examiner*—Noah P. Kamen

*Attorney, Agent, or Firm*—Browdy and Neimark

[57] ABSTRACT

Disclosed is a two-cycle internal combustion engine including a protruding edge portion formed in a section of a lower side surface of an intake port which is adjacent to a pre-compression chamber of a cylinder. This protruding edge portion serves to deflect air-fuel mixture introduced into the pre-compression chamber through the intake port so as to direct it to a bearing portion provided between a piston and a connecting rod. Further, a cut-in groove is formed in the protruding edge section and is adapted to allow any liquid remaining in the intake port to flow into the pre-comparison chamber.

1 Claim, 1 Drawing Sheet

TWO-CYCLE INTERNAL COMBUSTION ENGINE

BACKGROUND OF THE INVENTION

1. Field of the Invention

This invention relates to a two-cycle internal combustion engine.

2. The Prior Art

In a two-cycle internal combustion engine, a piston is arranged in a cylinder in such a manner that it can perform a reciprocating movement therein. This piston is connected with a crankshaft through the intermediary of a connecting rod. The movement of the piston toward top dead center introduces a air-fuel mixture into a pre-compression chamber (crankcase) through an intake port formed in the cylinder. The air-fuel mixture thus has been previously pressurized by the movement of the piston toward bottom dead center. The pressurized air-fuel mixture is supplied to a combustion chamber of the cylinder through scavenging channels. One end of the connecting rod is normally pivoted, through the intermediary of a bearing portion, to a piston pin mounted on the piston. In particular, in the case of a two-cycle internal combustion engine whose cylinder is so positioned in use that it extends upwards from the pre-compression chamber, there is some difficulty in effecting lubrication in the bearing provided between the connecting rod and the piston pin. Therefore, it is necessary to provide a needle roller or the like in the bearing portion between the connecting rod and the piston pin. Moreover, such members are have poor durability, and the load applied to them in use has to be restricted.

SUMMARY OF THE INVENTION

Accordingly, it is an object of this invention to provide a two-cycle internal combustion engine overcoming the problems in the prior art and having a configuration which is simple and practical.

In accordance with this invention, there is provided a two-cycle internal combustion engine having a cylinder, a reciprocating piston provided in said cylinder, a connecting rod pivoted to said piston through the intermediary of a bearing, and an intake port formed in the side wall of the cylinder so as to be opened and closed by the piston and so adapted as to supply air-fuel mixture into a pre-compression chamber (crankcase). The improvement comprises a protruding edge portion formed in the lower side of the intake port adjacent to the pre-compression chamber and adapted to deflect the air-fuel mixture to be introduced into the pre-compression chamber through the intake port toward the bearing which is provided between the piston and the connecting rod and which is in the vicinity of top dead center. There is further provided a cut-in groove formed in said protruding edge portion and adapted to allow any remaining liquid to flow into the pre-compression chamber from the intake port.

Accordingly, in the construction in accordance with this invention, the bearing between the piston and the connecting rod is forcibly-lubricated in the vicinity of top dead center with the air-fuel mixture deflected by the protruding edge portion of the intake port. The remaining liquid which is generated by liquefaction of the air-fuel mixture and which tends to remain in the intake port short of the protruding edge portion is allowed to flow into the cylinder chamber through the cut-in groove formed in the protruding edge portion, thus preventing liquid from remaining in the intake port. In other words, the protruding edge portion formed in the lower side of the intake port serves to deflect the air-fuel mixture toward the bearing between the piston and the connecting rod. The air-fuel mixture thus deflected enables with ease forced lubrication of said bearing. This enables the lubrication of the bearing to be maintained satisfactorily, thereby greatly improving the durability of the bearing. Further, this enables the load in use to be augmented. The cut-in groove formed in the protruding edge portion serves to prevent the liquid generated from liquefaction of the air-fuel mixture from staying in the intake port, thereby enabling an efficient supply of the air-fuel mixture. Thus, the present invention is able to provide a two-cycle internal combustion engine operating in a stable manner and having a simple structure which is easy to manufacture.

PREFERRED EMBODIMENT OF THE INVENTION

The present invention will now be described on the basis of the embodiment shown in the attached drawings.

Figure 1:
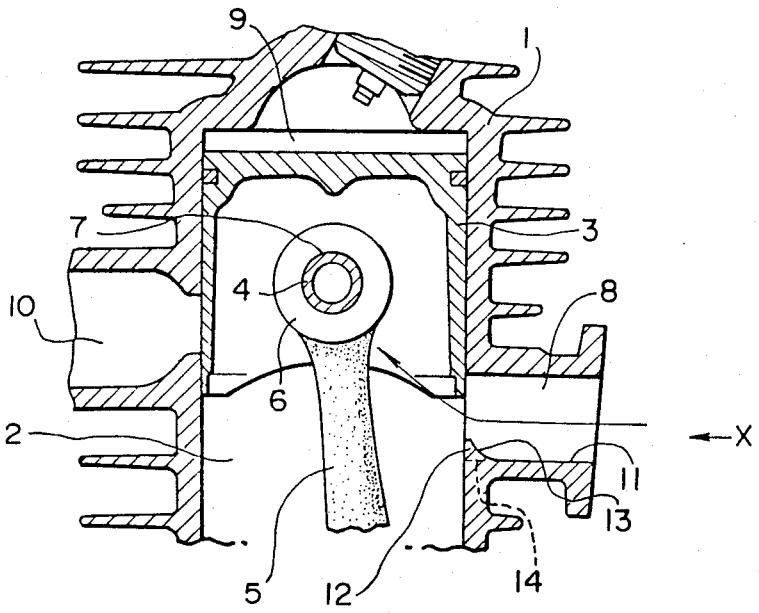
FIG. 1 is a schematic sectional view showing the essential parts of an embodiment of the two-cycle internal combustion engine of the present invention.
Figure 2:
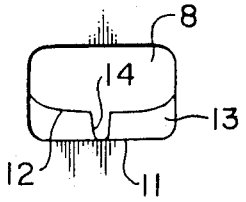
FIG. 2 is a schematic diagram showing a part of the engine shown in FIG. 1 as observed in the direction of arrow X in FIG. 1.

FIG. 1 is a schematic sectional view showing the essential parts of a two-cycle internal combustion engine to which the present invention is applied. This two-cycle internal combustion engine includes a cylinder 1 in upright position extending upwards from an ordinary crankcase (not shown). A piston 3 is arranged in the cylinder 1 in such a manner that it can perform reciprocating movement in the vertical direction. Said piston 3 has generally a cup-like, cylindrical configuration and includes a piston pin 4 inserted into the side wall of the piston 3 in such a manner that it traverses the inner space of the piston 3. An upper end portion 6 of a connecting rod 5 extending from a crank shaft (not shown) is pivoted to the piston pin 4 through the intermediary of a bearing portion 7 composed of an appropriate plane bearing or a roller bearing.

Formed in the side wall of the cylinder 1 is an intake port 8 having an aperture facing into a pre-compression chamber 2 communicating with the crankcase, said intake port 8 being supplied with mixture of fuel, lubricating oil and air by a carburetor not shown. When the piston 3 moves, as shown in FIG. 1, toward top dead center, said intake port 8 is opened and communicates with said pre-compression chamber 2, thereby allowing the air-fuel mixture to be introduced into the pre-compression chamber 2. When the piston 3 moves downwards, the communication between the intake port 8 and the pre-compression chamber 2 is interrupted. The air-fuel mixture thus sucked into the pre-compression chamber 2 is introduced into the crankcase by further downward movement of the piston 3 and is pressurized there. This pressurized air-fuel mixture is conveyed to a combustion chamber 9 of the cylinder 1 through scavenging channels by a well-known method. There it is ignited and combusted, thereby causing the piston 3 to move downwards. The combusted gas is discharged through an exhaust port 10.

So far, the construction and the operation of this embodiment are not different from those of conventional two-cycle internal combustion engines.

In the embodiment shown, however, a protruding edge 12 protruding upwards, in the direction traversing the intake port 8, is integrally formed in that portion of the lower side surface 11 of said intake port 8 which is adjacent to said pre-compression chamber 2. Said protruding edge portion 12 includes a curved upper surface 13 extending from the lower side surface 11 of the intake port 8 toward the upper section of the pre-compression chamber 2. This curved upper surface 13 causes the air-fuel mixture flowing along the lower side surface 11 of the intake port 8 to be deflected toward the upper section of the pre-compression chamber 2. When the air-fuel mixture is introduced into the pre-compression chamber 2 from the intake port 8, the air-fuel mixture which is thus deflected flows into the inner space of the piston 3, as shown in FIG. 1, and is sprayed on the bearing portion 7 provided between the piston pin 4 and the connecting rod 5, thereby effecting lubrication of the bearing portion 7.

Furthermore, a cut-in groove 14 with an aperture facing into the pre-compression chamber 2 is formed in the protruding edge portion 12 of said intake port 8. The bottom of said cut-in groove 14 is slightly inclined from the lower side surface 11 of the intake port 8 toward the pre-compression chamber 2. Because of the cut-in groove 14 thus formed, any liquefied fuel of the air-fuel mixture and the lubricaing oil which would otherwise stay on the lower side surface 11 of the intake port 8 short of the protruding edge portion 12 flows into the pre-compression chamber 2 through said cut-in groove 14, thus preventing liquid from remaining in the intake port 8 as well as any malfunction attributable thereto.

What is claimed is:

1. In a two-cycle internal combustion engine having a cylinder, a reciprocating piston provided in said cylinder, a connecting rod pivoted to said piston through the intermediary of a bearing portion, and an intake port formed in the side wall of the cylinder so as to be opened and closed by said piston and adapted to supply air-fuel mixture to a pre-compression chamber, the improvement comprises a protruding edge portion formed in a lower side surface of said intake port adjacent to said pre-compression chamber and adapted to deflect the air-fuel mixture introduced into said pre-compression chamber through said intake port toward said bearing portion which is provided between said piston and said connecting rod when the bearing portion is in the vicinity of top dead center, and a cut-in groove formed in said protruding edge portion substantially flush with said lower side surface for allowing any liquid remaining in said intake port to flow into said pre-compression chamber.

* * * * *